US011753604B2

(12) United States Patent
Bettiol et al.

(10) Patent No.: US 11,753,604 B2
(45) **Date of Patent: *Sep. 12, 2023**

(54) CLEANING PRODUCT

(71) Applicant: The Procter & Gamble Company, Cincinnati, OH (US)

(72) Inventors: Jean-Luc Philippe Bettiol, Etterbeek (BE); Roxane Rosmaninho, Auderghem (BE)

(73) Assignee: The Procter & Gamble Company, Cincinnati, OH (US)

( * ) Notice: Subject to any disclaimer, the term of this patent is extended or adjusted under 35 U.S.C. 154(b) by 103 days.

This patent is subject to a terminal disclaimer.

(21) Appl. No.: 17/160,986

(22) Filed: Jan. 28, 2021

(65) Prior Publication Data

US 2021/0230511 A1 Jul. 29, 2021

(30) Foreign Application Priority Data

Jan. 28, 2020 (EP) ..... 20154058
Aug. 25, 2020 (EP) ..... 20192540

(51) Int. Cl.

| | |
|---|---|
| ***C11D 1/12*** | (2006.01) |
| ***C11D 1/29*** | (2006.01) |
| ***C11D 1/72*** | (2006.01) |
| ***C11D 1/831*** | (2006.01) |
| ***C11D 3/43*** | (2006.01) |
| ***C11D 17/08*** | (2006.01) |
| ***B08B 3/04*** | (2006.01) |

(52) U.S. Cl.
CPC ..... *C11D 1/831* (2013.01); *C11D 1/12* (2013.01); *C11D 1/72* (2013.01); *C11D 17/08* (2013.01)

(58) Field of Classification Search
CPC .... C11D 1/12; C11D 1/29; C11D 1/72; C11D 1/831; C11D 3/43; C11D 17/08; B08B 3/04
See application file for complete search history.

(56) References Cited

U.S. PATENT DOCUMENTS

| | | | | |
|---|---|---|---|---|
| 5,726,141 | A | 3/1998 | Ofosu-asante | |
| 5,866,524 | A * | 2/1999 | Wevers | C11D 17/0043 510/427 |
| 5,888,957 | A | 3/1999 | Durbut et al. | |
| 5,919,312 | A | 7/1999 | Wierenga et al. | |
| 5,958,868 | A | 9/1999 | Pi et al. | |
| 5,968,491 | A | 10/1999 | Richardson | |
| 6,004,915 | A | 12/1999 | Elliott et al. | |
| 6,113,881 | A | 9/2000 | Bhatt et al. | |
| 6,133,212 | A | 10/2000 | Elliott et al. | |
| 6,270,300 | B1 | 8/2001 | Huber et al. | |
| 6,277,798 | B1 | 8/2001 | Elliott et al. | |
| 6,395,258 | B1 * | 5/2002 | Steer | A61K 8/892 424/70.13 |
| 6,720,300 | B1 | 4/2004 | Endlein et al. | |
| 10,138,446 | B2 | 11/2018 | Boers | |
| 2002/0037824 | A1 | 3/2002 | Smets et al. | |
| 2017/0354581 | A1 | 12/2017 | Consoli et al. | |
| 2019/0055500 | A1 | 2/2019 | Ceulemans | |
| 2019/0185785 | A1 * | 6/2019 | Seiler | C11D 1/662 |
| 2019/0191704 | A1 | 6/2019 | Albright et al. | |
| 2019/0376003 | A1 | 12/2019 | Sienkiewicz | |

FOREIGN PATENT DOCUMENTS

| | | | | |
|---|---|---|---|---|
| EP | 1078978 | A1 | 2/2001 | |
| EP | 0785981 | B1 | 4/2002 | |
| JP | 2001131579 | A | 5/2001 | |
| JP | 2004502832 | A | 1/2004 | |
| JP | 2004217908 | A | 8/2004 | |
| JP | 2016198765 | A | 12/2016 | |
| JP | 2017210576 | A | 11/2017 | |
| JP | 2017210577 | A | 11/2017 | |
| JP | 20196998 | A | 1/2019 | |
| JP | 2019104852 | A | 6/2019 | |
| JP | 2019104853 | A | 6/2019 | |
| JP | 2019104854 | A | 6/2019 | |
| JP | 2019104855 | A | 6/2019 | |
| JP | 2019182911 | A | 10/2019 | |
| JP | 2019182912 | A | 10/2019 | |
| JP | 2019182913 | A | 10/2019 | |
| JP | 2019182914 | A | 10/2019 | |
| JP | 2020200420 | A | 12/2020 | |
| WO | 9206161 | A1 | 4/1992 | |
| WO | WO 92/06160 | * | 4/1992 | C11D 1/835 |
| WO | 9519953 | A1 | 7/1995 | |
| WO | 9520026 | A1 | 7/1995 | |
| WO | WO 95/20026 | * | 7/1995 | C11D 1/835 |
| WO | 9612004 | A1 | 4/1996 | |
| WO | 0065014 | A1 | 11/2000 | |
| WO | 2016110827 | A1 | 7/2016 | |
| WO | 2017011191 | A1 | 1/2017 | |
| WO | 2017110773 | A1 | 6/2017 | |
| WO | 2017204148 | A1 | 11/2017 | |

(Continued)

OTHER PUBLICATIONS

All Office Actions, U.S. Appl. No. 17/160,974.
Extended European Search Report and Search Opinion; Application No. 20154058.0; dated Jul. 17, 2020; 8 pages.
Extended European Search Report and Search Opinion; Application No. 20192540.1; dated Feb. 10, 2021; 8 pages.

*Primary Examiner* — Brian P Mruk
(74) *Attorney, Agent, or Firm* — George H. Leal; Melissa Gartstein Krasovec; Carolyn S. Powell

(57) ABSTRACT

The need for a cleaning product comprising a spray dispenser and a cleaning composition, which provides improved polymeric grease cleaning and suds mileage, and hence reduced time to clean the dishes, is met by a cleaning product comprising a spray dispenser and a cleaning composition, the composition is housed in the spray dispenser and wherein the cleaning composition comprises anionic surfactant and alkyl glucamide surfactant.

20 Claims, No Drawings

(56) References Cited

FOREIGN PATENT DOCUMENTS

| | | | |
|---|---|---|---|
| WO | 2017204149 | A1 | 11/2017 |
| WO | 2019188140 | A1 | 10/2019 |
| WO | 2019235424 | A1 | 12/2019 |
| WO | 2019235425 | A1 | 12/2019 |

* cited by examiner

CLEANING PRODUCT

FIELD OF INVENTION

The present invention relates to a cleaning product comprising a spray dispenser and a cleaning composition, which provides improved polymerized grease cleaning and good suds mileage.

BACKGROUND OF THE INVENTION

Traditionally manual dishwashing has been performed by filling a sink with water, adding a dishwashing detergent to create a soapy solution, immersing the soiled articles in the solution, scrubbing the articles and rinsing to remove the remaining soils and remove the suds generated from the soapy solution from the washed articles. Traditionally an entire load of soiled dishware has usually been washed in one go. Nowadays some users prefer to clean articles as soon as they have finished with them rather than wait until they have a full load. This involves washing one article or a small number of articles at the time. The washing is usually performed under running water rather than in a full sink. The cleaning should be fast and involve minimum effort from the user. In such washing under the tap, the user typically delivers detergent to a sponge. This has the disadvantage of often dosing more detergent than is actually needed, especially when there are only a few items to be washed. Moreover, excessive amounts of detergent require more water and more time to rinse.

The use of a cleaning product comprising a spray dispenser and a cleaning composition alleviates such problems. However, it remains challenging to formulate a cleaning composition for a spray product which cleans tough to remove greasy soils, and especially polymeric grease.

Polymerized greases are typically liquid grease at room temperature that after exposure to elevated temperatures such as baking or roasting conditions, have polymerized into more viscous or solid greases. Such polymerised greases are typically derived from vegetable or seed oils such as sunflower oil, peanut oil, corn oil, olive oil and the like, which have been polymerised after cooking in the oven or frying pan. Typically, good removal of such polymeric grease has required higher levels of a typically alkaline detergent composition applied for longer durations, e.g. soaking the dishware with the detergent, and intense scrubbing in order to lift and emulsify the polymeric grease. However, the need for such soaking time leads to more time needed to wash the dishes, and hence, less satisfied users. Moreover, such polymeric greases typically suppress sudsing as the grease is emulsified, leading to low suds mileage. A lower suds mileage typically signals to consumers to re-dose the cleaning composition, despite that sufficient cleaning power might in reality still be present, leading to an increased product consumption and lower product value perception.

Hence, a need remains for a cleaning product comprising a spray dispenser and a cleaning composition, which provides improved polymeric grease cleaning and suds mileage, and hence reduced time to clean the dishes.

EP3118301B1 relates to a cleaning product, in particular, to a cleaning product comprising a spray dispenser and a cleaning composition for making the cleaning of dishware easier and faster. JP2016198765 relates to a high foaming cleaning method for tableware, especially for removing oil from portions of the dishware which are hard to reach or unreacheable by hand. WO2017204149A1 relates to a detergent composition which exhibits excellent detergency against solid fat-containing oil stains attached to hard surfaces, including tableware, wherein the detergent composition can be applied to the hard surface via a spray. WO2017204148A1 relates to a method for washing tableware without applying thereto mechanical force, by causing a liquid detergent composition which contains not less than 1 mass % of a surfactant, not less than 1 mass % of a chelating agent, and water, to be in contact with tableware having an oil stain such as a solid fat stain, wherein the mass ratio of the surfactant and chelant is not lower than 0.25 and the liquid detergent composition has an electrical conductivity at 25° C. of not less than 0.70 S/m. JP2017210577A relates to a liquid detergent composition for tableware that has excellent low-temperature stability and can satisfactorily clean oil stains, including solid fat, attached to a surface of tableware, without rubbing with a flexible material such as sponge, and without applying mechanical force, by applying, for instance via a spray, a liquid detergent composition containing a branched anion surfactant, a glycol solvent having from 2 to 12 carbon atoms, and water. JP2017210576A relates to a liquid detergent composition for hard surfaces, including tableware, having excellent detergency on oil stains, including solid fat, attached to a plastic hard surface, and a method for cleaning a hard surface using the composition, the composition comprises a sulfosuccinic acid ester or a salt thereof, an anion surfactant containing a hydrocarbon group having carbon atoms of 8 or more and 21 or less and a sulfate ester group or a sulfonic acid group, a specific nonionic surfactant, and water. WO2017110773A relates to a liquid detergent composition for hand-dishwashing, including tableware, having excellent detergency on oil stains, the composition comprising a sulfosuccinic acid ester or a salt thereof, a further anionic surfactant having a hydrocarbon group with 8 to 21 carbon atoms and a sulfuric ester group or sulfonic acid group, an amphoteric surfactant, and water. WO2016110827A1 relates to a detergent solution which can be applied as a spray, for cleaning a receptacle for milk or liquid milk-derived products, the detergent solution comprising water, one or more types of surfactant and an odour absorbing compound, the surfactants dissolve greasy milk-based residues from the receptacle and the odour absorbing compound neutralises odours produced by any remaining milk-based residues not removed by the surfactants. WO2017011191A1 relates to a cleaning product comprising a spray dispenser and a cleaning composition housed in the spray dispenser, the composition comprises: 5% to 15% by weight of the composition of a surfactant system, wherein the surfactant composition comprises: ii. 40% to 90% by weight of the surfactant system of a non-ionic surfactant and 10 to 60% by weight of the surfactant system of a co-surfactant selected from anionic, amphoteric, zwitterionic and mixtures thereof; and a glycol ether solvent. U.S. Pat. No. 5,888,957A relates to an all purpose cleaning or microemulsion composition which is positioned as more environmentally friendly, which is especially effective in the removal of a mixtures of oil and kaolin soil, and which contains an analephotropic negatively charged complex, a hydrocarbon ingredient, a cosurfactant, and water. WO2019235424A relates to a liquid detergent composition for tableware and/or rigid kitchen articles, the liquid detergent composition contains (a) a non-ionic surfactant (excluding (b)) that has an HLB of 10.5 or lower, (b) a glycoside that has a C8-18 hydrocarbon group and a glycoside group that has an average degree of condensation of 0.5-3, and (c) an organic solvent that has a log Pow of 0-1.5, wherein the amount of (a) is 30-95 mass % of the total surfactant, the mass ratio (c)/(a) of component (c) to the amount of (a) is 2-8, and the viscosity of the liquid detergent composition at 20° C. is 20 mPa·s or lower. WO2019235425A relates to a liquid detergent composition for tableware and/or rigid kitchen articles, the liquid detergent composition contains (a) a non-ionic surfactant that has an HLB of 10.5 or lower, (b) a surfactant selected from amine oxide surfactants, amphoteric surfactants, and non-ionic surfactants that have an HLB of 11 or higher, and (c) an organic solvent that has a log Pow of 0-1.5, wherein the (a) component fraction of the total surfactant is 30-85 mass %, the mass ratio (c)/(a) is 1-10, and the viscosity of the liquid detergent composition at 20° C. is 20 mPa·s or lower. JP2019182911A relates to a tableware and/or kitchen for cleaning dirt containing solid fat adhering to tableware, etc., having improved enzyme and composition stability, the liquid detergent composition comprising (a) 0.01% to 5.0% by weight of a sulfosuccinic acid alkyl ester having 5 to 18 carbon atoms in an alkyl group or a salt thereof, (b) 0.01% to 5.0% by weight of one or more surfactants selected from semipolar surfactants and amphoteric surfactants, and (c) enzyme, the composition further comprising water and having a mass ratio of (a) to (b) of 0.01 to 100. JP2019182912A relates to a liquid cleaning composition for tableware and/or hard articles around a kitchen, for cleaning both protein-containing soil and solid fat-containing soil adhered to tableware, the composition comprising (a) 0.01% to 5.0% by weight of an anionic surfactant, (b) 0.01% to 5.0% by weight of a semipolar surfactant or an amphoteric surfactant, and (c) an enzyme, wherein the mass ratio of (a) to (b) is 1 or more and less than 99, and the viscosity is 10 mPas or less. JP2019182913A relates to a liquid detergent for tableware and/or a hard article around a kitchen, for cleaning fat and oil stains and starch stains attached to tableware, etc., and having improved enzyme and composition stability, the composition comprising (a) 0.01% to 5.0% by mass of an anionic surfactant, (b) 0.01% to 5.0% by mass of a semipolar surfactant or an amphoteric surfactant, (c) 0.1 ppm or more and 1000 ppm or less of an enzyme, and water, with a mass ratio of (a) to (b) of from 0.01 to 1. JP2019182914A relates to a tableware and/or a liquid cleaning composition for hard articles around a kitchen, for cleaning dirt containing liquid oil adhering to the tableware, the composition comprising (a) 0.01% to 5.0% by mass of an anionic surfactant, (b) 0.01% to 5.0% by mass of a semipolar surfactant or an amphoteric surfactant, (c) 0.1 ppm or more and 1000 ppm or less of an enzyme, and (d) one or more viscosity modifiers selected from hydrotropes, with a mass ratio of (a) to (b) of 0.25 to 4. JP2019104852A relates to a cleaning method for cleaning oil stains including solid fat adhered to tableware and hard articles around a kitchen, which provides improved foaming during cleaning and defoaming during rinsing, the composition comprising (a) one or more surfactants selected from a sulfosuccinic acid alkyl ester having 5 to 18 carbon atoms in an alkyl group or a salt thereof, (b) One or more surfactants selected from a semipolar surfactant, and an amphoteric surfactant, (c) one or more solvents selected from a solvent selected from glycerin, ethanol, propanol, ethylene glycol, propylene glycol, alkyl cellosolve (having 1 to 9 carbon atoms in the alkyl group), alkyl carbitol (having 1 to 9 carbon atoms in the alkyl group), alkyl glyceryl ethers (having 1 to 9 carbon atoms in the alkyl group), and (d) a compound containing an atom selected from calcium, zinc, copper, and boron [excluding component (a)], with a mass ratio of (a) to (b) from 1.5 to 99. JP2019104853A relates to a method for cleaning tableware and/or a hard article around a kitchen, having improved cleaning of oil stains including solid fat, and improved foaming and foaming properties, the liquid detergent composition comprising (a) one or more surfactants selected from an anionic surfactant, (b) one or more surfactants selected from a semipolar surfactant and an amphoteric surfactant, (c) one or more solvents selected from divalent or trivalent alcohols and ethers of divalent or trivalent alcohols having an alkyl group having 1 to 9 carbon atoms, (d) a compound containing an atom selected from calcium, magnesium, copper and boron (excluding the component (a)), and water, wherein the total content of (a) and (b) is 20% or more of the total surfactant, and the composition has a mass ratio of (a) to (b) of 1.5 to 99. JP2019104854 relates to a method for cleaning tableware and/or a hard article around a kitchen, especially oily dirt containing solid fat adhered to the tableware and a hard article, the liquid detergent composition comprising (a) one or more anionic surfactants selected from an alkylaryl sulfonic acid type surfactant, a sulfate ester type surfactant, an alkane sulfonic acid type surfactant, an olefin sulfonic acid type surfactant, and a sulfo-fatty acid ester type surfactant, (b) one or more surfactants selected from semipolar surfactants and amphoteric surfactants, (c) one or more solvents selected from divalent or trivalent alcohols and ethers of divalent or trivalent alcohols having an alkyl group having 1 to 9 carbon atoms, (d) a compound containing an atom selected calcium, magnesium, copper and boron (excluding component (a)) and water, and the total content of the component (a) and the component (b) is 20% by mass or less in the total surfactant and wherein the mass ratio of (a) to (b) is 0.6 to 1.5. JP2019104855A relates to a washing method, a detergent composition and a detergent article, for cleaning oil contaminant containing solid fat adhered to tableware or hard articles in a kitchen even without mechanical force, which has good foam stability, and less skin irritation, using a liquid detergent composition containing (a) one or more kind of anion surfactant selected from an alkylarylsulfonic acid-type surfactant, a sulfuric ester-type surfactant, an alkanesulfonic acid-type surfactant, an olefin sulfonic acid-type surfactant, and sulfo aliphatic acid ester-type surfactant, and (b) one or more surfactant selected from a semi-polar surfactant and an ampholytic surfactant, with a mass ratio of (a) to (b) of 0.01 to 0.6. WO2019188140A relates to a liquid detergent composition which contains a component (A), a component (B) and a component (C), wherein (A) is an anionic surfactant; (B) is a specific organic solvent compound; (C) is at least one surfactant selected from the group consisting of amphoteric surfactants and amine oxide surfactants; and the mass ratio of (A)) to (B) is 0.06 to 45. US20020037824A relates to detergent compositions, including laundry, dishwashing, and/or hard surface cleaner compositions, comprising a maltogenic alpha-amylase enzyme and a detergent ingredient selected from the group consisting of a nonionic surfactant, a protease, a bleaching agent and/or mixtures thereof, in which suitable nonionic surfactants include polyhydroxy fatty acid amides such as C16-C18 alkyl N-methyl glucamide.

SUMMARY OF THE INVENTION

The present invention relates to a cleaning product comprising a spray dispenser and a cleaning composition, the cleaning composition is housed in the spray dispenser and wherein the cleaning composition comprises from 5% to 25% by weight of a surfactant system, wherein the surfactant system comprises: an anionic surfactant; and an alkyl glucamide surfactant, wherein the alkyl glucamide surfactant has the formula:

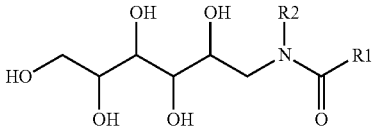

(I)

wherein in formula (I): R1 is a linear or branched, saturated or unsaturated alkyl chain comprising from 8 to 18 carbon atoms; and R2 is an alkyl group having from 1 to 4 carbon atoms, wherein the anionic surfactant and alkyl glucamide surfactant are present at a weight ratio of greater than 1:1.

The present invention further relates to a method of cleaning soiled dishware using the product according to the invention comprising the steps of: optionally pre-wetting the soiled dishware; spraying the cleaning composition onto the soiled dishware; optionally scrubbing the dishware; and rinsing the dishware.

DETAILED DESCRIPTION OF THE INVENTION

The need for a cleaning product comprising a spray dispenser and a cleaning composition, which provides improved polymeric grease cleaning and improved suds mileage is met by formulating the cleaning composition with a surfactant system comprising an anionic surfactant and an alkyl glucamide surfactant. Such cleaning compositions have been found to improve the emulsification of polymeric grease, even though they contain relatively low total surfactant levels. The cleaning composition is also found to provide long lasting foam even in the presence of polymeric grease, triggering less product re-dosing and increased product value perception accordingly. Moreover, since the detergent composition is comprised in a spray container, the composition can be uniformly applied to the surface of the article and left for a period in order to further loosen polymeric grease, as part of a pretreatment step before the main cleaning step.

The present invention relates to a cleaning product, which is a hand dishwashing cleaning product, the product comprising a spray dispenser and a cleaning composition. The cleaning composition is comprised within the spray dispenser.

For the purpose of the present invention "dishware" encompasses all the items used to either cook or used to serve and eat food.

By "spray dispenser" is herein meant a container comprising a housing to accommodate the composition and means to spray that composition. The preferred spraying means being a trigger spray. The composition of use in the present invention foams when it is sprayed on the surface to be treated.

Cleaning Composition:

The cleaning composition is preferably a hand dishwashing cleaning composition, preferably in liquid form. The cleaning composition is suitable for spraying.

Preferably the pH of the composition is greater than 8, more preferably from 10 to 12 and most preferably from 10.5 to 11.5, as measured neat at 20° C. Preferably, the composition has a reserve alkalinity of from 0.1 to 1, more preferably from 0.1 to 0.5 measured as described herein. This pH and the reserve alkalinity further contribute to the cleaning of tough food soils, especially including polymerized greases.

The cleaning product according to the invention can comprise a composition having a Newtonian viscosity, such as from 1 mPa·s to 50 mPa·s, preferably from 1 mPa·s to 20 mPa·s, more preferably from 1 mPa·s to 10 mPa·s, at 20° C. as measured using the method defined herein.

Alternatively the cleaning product according to the invention can comprise a composition having a shear thinning rheology profile, such as having a high shear viscosity of from 1 mPa·s to 50 mPa·s, preferably from 1 mPa·s to 20 mPa·s, more preferably from 5 mPa·s to 15 mPa·s, when measured at a shear rate of at 1000 $s^{-1}$ at 20° C., and a low shear viscosity of from 100 mPa·s to 1,000 mPa·s, preferably from 200 mPa·s to 500 mPa·s, when measured at 0.1 $s^{-1}$ at 20° C., using the method defined herein.

Preferably the cleaning composition of use in the invention has a Newtonian viscosity.

The liquid cleaning composition typically comprises an aqueous carrier in which all the other composition actives are dissolved or eventually dispersed. As such, water can be present in an amount of from 60% to 90%, preferably from 75% to 85% by weight of the composition.

Surfactant System:

The composition comprises from 5% to 25%, preferably from 7% to 20%, more preferably from 10% to 15% by weight thereof of a surfactant system. The surfactant system comprises an anionic surfactant and an alkyl glucamide surfactant. The anionic surfactant and alkyl glucamide surfactant are present at a weight ratio of greater than 1:1, preferably from greater than 1:1 to 10:1, preferably from 1.5:1 to 5:1, more preferably from 2:1 to 3:1.

Anionic Surfactant:

The surfactant system preferably comprises the anionic surfactant at a level of from 2.0% to 12%, preferably from 3.0% to 10%, more preferably from 5.0% to 7.5% by weight of the composition. Compositions having a surfactant system especially comprising an alkyl sulphate anionic surfactant have been found to be very good from a cleaning and sudsing viewpoint. They have also been found to be very good from a spray pattern view point. The presence of small droplets (and therefore the risk of inhalation) is minimized when the surfactant system of the composition of use in the invention contains such anionic surfactant. As such, alkyl sulphated anionic surfactants are preferred, particularly those selected from the group consisting of: alkyl sulphate, alkyl alkoxy sulphate, and mixtures thereof. More preferably, the anionic surfactant consists of alkyl sulphated anionic surfactant selected from the group consisting of: alkyl sulphate, alkyl alkoxy sulphate, and mixtures thereof. If alkyl alkoxy sulphates are present, alkyl ethoxy sulphates are preferred.

The alkyl ethoxylated sulphate preferably has an average degree of ethoxylation of no more than 5, preferably from 1.0 to 5.0, more preferably from 2 to 4, most preferably from 2.5 to 3.5. It has been found that alkyl ethoxylated sulfate with such an average degree of ethoxylation provides a good balance of improved cleaning, and especially speed of cleaning, and sudsing as well as more robust physical stability especially at lower temperatures than other ethoxylated alkyl sulfate surfactants with a lower or higher degree of ethoxylation. However, lower levels of ethoxylation of from 0 to 1.0 provide improved suds mileage and grease emulsification, despite the challenge of less robust physical stability, especially at low temperatures. The average degree of alkoxylation is the mol average degree of alkoxylation (i.e., mol average alkoxylation degree) of all the alkyl sulphate anionic surfactant. Hence, when calculating the mol average alkoxylation degree, the mols of non-alkoxylated sulphate anionic surfactant are included:

$$\text{Mol average alkoxylation degree}=(x1*\text{alkoxylation degree of surfactant 1}+x2*\text{alkoxylation degree of surfactant 2}+\ldots)/(x1+x2+\ldots)$$

wherein x1, x2, . . . are the number of moles of each alkyl (or alkoxy) sulphate anionic surfactant of the mixture and alkoxylation degree is the number of alkoxy groups in each alkyl sulphate anionic surfactant.

The alkyl sulphate anionic surfactant is preferably essentially linear. As such, the alkyl chain of the alkyl sulphate anionic surfactant preferably comprises fully linear alkyl chains, or comprises on average no more than 20% by weight of the alkyl chains in the alkyl sulphate anionic surfactant of alkyl branching, typically the alkyl branching being dominantly at the C2 position (as measured counting carbon atoms from the sulphate group for non-alkoxylated alkyl sulphate anionic surfactants, and the counting from the alkoxy-group furthest from the sulphate group for alkoxylated alkyl sulphate anionic surfactants), especially C1 to C4 alkyl branching groups, more especially methyl. Most preferably the alkyl chain in the alkyl sulphate anionic surfactant is fully linear. Fully linear alkyl chains are typically derived from natural sources such as palm oil, coconut oil, and the like. Lightly branched alkyl sulphates can be formed from synthetically derived alcohols, such as prepared using the Ziegler and OXO processes.

In the case of a single surfactant the percentage of branching refers to the weight percentage of the hydrocarbyl chains that are branched in the original alcohol from which the surfactant is derived. In the case of a surfactant mixture the percentage of branching is the weight average and it is defined according to the following formula:

$$\text{Weight average degree of branching (\%)}=(x1*\text{wt \% branched alcohol in alcohol 1}+x2*\text{wt \% branched alcohol in alcohol 2}\ldots)/(x1+x2+\ldots)$$

wherein x1, x2, . . . are the weight in grams of each alcohol in the total alcohol mixture of the alcohols which were used as starting material for the anionic surfactant for the detergent of the invention. In the weight average branching degree calculation, the weight of anionic surfactant components not having branched groups should also be included.

The alkyl sulphated anionic surfactant preferably has an average alkyl chain length of from 8 to 18, preferably from 10 to 14, more preferably from 12 to 14, most preferably from 12 to 13 carbon atoms.

Suitable counterions include alkali metal cation earth alkali metal cation, alkanolammonium or ammonium or substituted ammonium, but preferably sodium.

Suitable alkyl alkoxy sulfates are commercially available with a variety of chain lengths, ethoxylation and branching degrees. Commercially available sulfates include, those based on Neodol alcohols ex the Shell company, Lial-Isalchem and Safol ex the Sasol company, natural alcohols ex The Procter & Gamble Chemicals company. Preferably the alkyl sulphate anionic surfactant is derived from Neodol alcohols or natural alcohols, most preferably natural alcohols.

For further improvements in sudsing, the surfactant system can comprise less than 30%, preferably less than 15%, more preferably less than 10% by weight of the surfactant system of further anionic surfactant, and most preferably the surfactant system comprises no further anionic surfactant.

Alkyl Glucamide Surfactant:

The composition comprises one or more alkyl glucamide surfactants according to Formula (I):

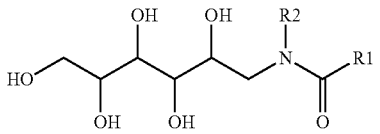

(I)

Wherein in formula (I):

R1 is a linear or branched, saturated or unsaturated alkyl chain comprising from 8 to 18 carbon atoms. Preferably, R1 is a C8-C18, preferably a C8-C14, more preferably a C12-C14 alkyl chain. R1 is preferably derived from coconut oil, since coconut oil comprises a dominance of 12 to 14 carbon atoms within the alkyl chains. The lower alkyl chain lengths are preferred since they result in further improved grease cleaning and suds mileage. It is believed that this is due to improved surfactant packing, in combination with the anionic surfactant.

R2 is an alkyl group having from 1 to 4 carbon atoms. Preferably R2 is an alkyl group having from 1 to 2 carbon atoms. More preferably R2 is methyl.

The cleaning composition can comprise the alkyl glucamide surfactant at a level of from 0.5% to 5.0%, preferably from 1.0% to 4.0%, more preferably from 2.0% to 3.0%-by weight of the composition.

The preparation of the alkylglucamides of the formula (I) has been well described before, such as in EP0633244, EP1110944, WO2016075080, EP0550603A, EP0550632A and EP0550651A, and is known to the skilled person. It is accomplished, for example, by condensing carboxylic esters with a secondary N-alkylglucamine, which in its turn may be prepared by reductive amination from a sugar such as D-glucose.

Suitable alkylglucamides include n-octyl-n-methylglucamide, n-decyl-n-methylglucamide, n-dodecyl (or lauryl)-n-methylglucamide, n-myristyl-n-methylglucamide, n-palmityl-n-methylglucamide and n-oleyl-n-methylglucamide, and mixtures thereof, preferably n-dodecyl-n-methylglucamide, n-myristyl-n-methylglucamide and mixtures thereof. The most preferred alkyl glucamide according to the invention is n-C12-14 alkyl-n-methylglucamide, preferably derived from coconut oil.

When derived from glucose and natural oils, such alkyl glucamide surfactants have a Renewable Carbon Index (RCI) under ISO 16128 of from 94% to 96% and are particularly suitable for use in detergent compositions to be sold under a "natural" proposition.

Alkyl glucamide surfactants are commercially available from Clariant under the GlucoPure tradename. Most preferred material is GlucoPure Foam, derived from coconut oil and glucose.

Further Non-Ionic Surfactant:

The surfactant system can comprise further non-ionic surfactant. If present, the surfactant system can comprise from 0.5% to 10%, preferably from 1.0% to 8.0%, more preferably from 2.0% to 6.0% by weight of the composition of the further nonionic surfactant.

Suitable further non-ionic surfactants include alkyl alkoxylated non-ionic surfactants, more preferably ethoxylated non-ionic surfactants. Suitable nonionic surfactants include the condensation products of aliphatic alcohols with from 1 to 25 moles of ethylene oxide. The alkyl chain of the aliphatic alcohol can either be straight or branched, primary or secondary, preferably straight The further nonionic surfactant can be a low-cut alkyl ethoxylate surfactant. Low-cut alcohol ethoxylate surfactants include alcohol ethoxylate surfactants with an average alkyl carbon chain length of C10 and below. More preferably the alkyl ethoxylate surfactant has an average alkyl chain length of between C5 to C8, preferably between C5 to C7, and a number average degree of ethoxylation of from 1 to 10, preferably from 3 to 8, more preferably from 4 to 6. Suitable non-ionic alcohol ethoxylate surfactants include commercially available materials such as Emulan® HE50 or Lutensol® CS6250 (available from BASF).

Most preferably the surfactant system consists of an alkyl sulphate anionic surfactant, an alkyl glucamide surfactant and an alkyl ethoxylate surfactant, especially a low-cut alcohol ethoxylate surfactant as described earlier.

Most preferably the surfactant system consists of i) from 5.0 to 7.5% of an alkyl ethoxy sulphate anionic surfactant, preferably a C12-14 AE3S anionic surfactant, ii) 2.0 to 3.0% of an alkyl glucamide surfactant, preferably n-C12C14 alkyl-n-methyl glucamide surfactant, and iii) from 4.0% to 6.0% of a low cut alcohol ethoxylate nonionic surfactant, preferably having an average alkyl chain length of between C5 and C7 and a number average degree of ethoxylation of from 4 to 6.

Other Surfactants:

The surfactant system comprises less than 0.5%, preferably less than 0.1% by weight of the cleaning composition of an amphoteric surfactant, zwitterionic surfactant, and mixtures thereof. In more preferred embodiments, the cleaning composition is free of amphoteric and zwitterionic surfactants.

Zwitterionic and amphoteric surfactants have both cationic and anionic centres attached to the same molecule. The cationic part is typically based on primary, secondary, or tertiary amines or quaternary ammonium cations. The anionic part can include sulfonates, for instance to form sultaines. Betaines such as cocamidopropyl betaine have a carboxylate with the ammonium group. Amphoteric surfactants include such surfactants as amine oxide surfactants.

The compositions of use in the present invention are preferably free of cationic surfactant and especially free of antimicrobial cationic surfactants, since such surfactants are typically detrimental to grease cleaning and surface shine. Such antimicrobial cationic surfactants include quaternary ammonium compounds such as dodecyl dimethyl ammonium chloride, alkyl dimethyl benzyl ammonium chloride, alkyl dimethyl ethylbenzyl ammonium chloride, and mixtures thereof.

Organic Solvent:

For improved penetration and removal of polymerized grease as well as crystalline grease, the composition can further comprise an organic solvent. The composition can comprise from 0.1% to 10%, preferably from 1.0% to 8.0%, more preferably from 3.0% to 7.0% by weight of the total composition of the organic solvent.

Suitable organic solvents can be selected from the group consisting of: glycol ether solvents, alcohol solvents, ester solvents, and mixtures thereof, with glycol ether solvents being preferred as they are particularly effective when used in combination with the alkyl glucamide surfactant to remove polymerized and crystalline grease, and can also improve sudsing.

The surfactant system and the organic solvent are preferably in a weight ratio of from 5:1 to 1:5, preferably from 4:1 to 1:2, most preferably 3:1 to 1:1. Compositions of use in the present invention, having such a weight ratio of surfactant system to organic solvent have been found to provide improved coverage on the dishware with minimum over-spray (residual spray droplets remaining in suspension in the air). Therefore, such spray compositions reduce wastage and minimise the amount of spray droplets which can be inhaled. Compositions having a surfactant:solvent weight ratio lower than 1:5 have been found to be less foaming and/or have a greater tendency to phase separate over time. Compositions having a surfactant:solvent weight ratio higher than 5:1 are typically more difficult to spray and are more prone to gelling when sprayed onto greasy soils, when the soil is not first wetted. Such gel formation inhibits the spreading of the composition onto the greasy surface and hence leads to less satisfactory cleaning.

Suitable glycol ether solvents can be selected from the group consisting of:

a) Formula I: R1O(R2O)nR3,
   R1 is a linear or branched C4, C5 or C6 alkyl or a substituted or unsubstituted phenyl, R2 is ethyl or isopropyl, R3 is hydrogen or methyl and n is 1, 2 or 3;
b) Formula II: R4O(R5O)nR6,
   R4 is n-propyl or isopropyl, R5 is isopropyl, R6 is hydrogen or methyl and n is 1, 2 or 3; and
c) mixtures thereof Suitable alcohol solvents can be selected from the group consisting of: C4-C6 linear mono-alcohols, branched C4-C10 mono-alcohols having one or more C1-C4 branching groups, alkyl mono-glycerols, and mixtures thereof Suitable ester solvents can be selected from the group consisting of glycol ethers of:

a) monoesters having the formula R1C═OOR2,
   wherein R1 is a linear or branched C1 to C4 alkyl, and R2 is a linear or branched C2 to C8 alkyl;
b) di- or tri-esters having the formula R1(C═OOR2)n,
   R1 is a saturated or unsaturated C2 to C4 alkyl, R2 is independently selected from a linear or branched C2 to C8 alkyl, and n is 2 or 3;
c) benzylbenzoate; and
d) mixtures thereof.

The surfactant system and the organic solvent can be in a weight ratio of from 5:1 to 1:5, preferably from 4:1 to 1:2, most preferably 3:1 to 1:1.

Suitable glycol ether solvents can be selected from glycol ethers of Formula I, Formula II, and mixtures thereof:

a) Formula I=R1O(R2O)nR3
wherein
R1 is a linear or branched C4, C5 or C6 alkyl, a substituted or unsubstituted phenyl, preferably n-butyl. Benzyl is one of the substituted phenyls for use herein.
R2 is ethyl or isopropyl, preferably isopropyl
R3 is hydrogen or methyl, preferably hydrogen
n is 1, 2 or 3, preferably 1 or 2
b) Formula II=R4O(R5O)nR6
wherein
R4 is n-propyl or isopropyl, preferably n-propyl
R5 is isopropyl
R6 is hydrogen or methyl, preferably hydrogen
n is 1, 2 or 3 preferably 1 or 2

Suitable glycol ether solvents according to Formula I include ethyleneglycol n-butyl ether, diethyleneglycol n-butyl ether, triethyleneglycol n-butyl ether, propyleneglycol n-butyl ether, dipropyleneglycol n-butyl ether, tripropyleneglycol n-butyl ether, ethyleneglycol n-pentyl ether, diethyleneglycol n-pentyl ether, triethyleneglycol n-pentyl ether, propyleneglycol n-pentyl ether, dipropyleneglycol n-pentyl ether, tripropyleneglycol n-pentyl ether, ethyleneglycol n-hexyl ether, diethyleneglycol n-hexyl ether, triethyleneglycol n-hexyl ether, propyleneglycol n-hexyl ether, dipropyleneglycol n-hexyl ether, tripropyleneglycol n-hexyl ether, ethyleneglycol phenyl ether, diethyleneglycol phenyl ether, triethyleneglycol phenyl ether, propyleneglycol phenyl ether, dipropyleneglycol phenyl ether, tripropyleneglycol phenyl ether, ethyleneglycol benzyl ether, diethyleneglycol benzyl ether, triethyleneglycol benzyl ether, propyleneglycol benzyl ether, dipropyleneglycol benzyl ether, tripropyleneglycol benzyl ether, ethyleneglycol isobutyl ether, diethyleneglycol isobutyl ether, triethyleneglycol isobutyl ether, propyleneglycol isobutyl ether, dipropyleneglycol isobutyl ether, tripropyleneglycol isobutyl ether, ethyleneglycol isopentyl ether, diethyleneglycol isopentyl ether, triethyleneglycol isopentyl ether, propyleneglycol isopentyl ether, dipropyleneglycol isopentyl ether, tripropyleneglycol isopentyl ether, ethyleneglycol isohexyl ether, diethyleneglycol isohexyl ether, triethyleneglycol isohexyl ether, propyleneglycol isohexyl ether, dipropyleneglycol isohexyl ether, tripropyleneglycol isohexyl ether, ethyleneglycol n-butyl methyl ether, diethyleneglycol n-butyl methyl ether triethyleneglycol n-butyl methyl ether, propyleneglycol n-butyl methyl ether, dipropyleneglycol n-butyl methyl ether, tripropyleneglycol n-butyl methyl ether, ethyleneglycol n-pentyl methyl ether, diethyleneglycol n-pentyl methyl ether, triethyleneglycol n-pentyl methyl ether, propyleneglycol n-pentyl methyl ether, dipropyleneglycol n-pentyl methyl ether, tripropyleneglycol n-pentyl methyl ether, ethyleneglycol n-hexyl methyl ether, diethyleneglycol n-hexyl methyl ether, triethyleneglycol n-hexyl methyl ether, propyleneglycol n-hexyl methyl ether, dipropyleneglycol n-hexyl methyl ether, tripropyleneglycol n-hexyl methyl ether, ethyleneglycol phenyl methyl ether, diethyleneglycol phenyl methyl ether, triethyleneglycol phenyl methyl ether, propyleneglycol phenyl methyl ether, dipropyleneglycol phenyl methyl ether, tripropyleneglycol phenyl methyl ether, ethyleneglycol benzyl methyl ether, diethyleneglycol benzyl methyl ether, triethyleneglycol benzyl methyl ether, propyleneglycol benzyl methyl ether, dipropyleneglycol benzyl methyl ether, tripropyleneglycol benzyl methyl ether, ethyleneglycol isobutyl methyl ether, diethyleneglycol isobutyl methyl ether, triethyleneglycol isobutyl methyl ether, propyleneglycol isobutyl methyl ether, dipropyleneglycol isobutyl methyl ether, tripropyleneglycol isobutyl methyl ether, ethyleneglycol isopentyl methyl ether, diethyleneglycol isopentyl methyl ether, triethyleneglycol isopentyl methyl ether, propyleneglycol isopentyl methyl ether, dipropyleneglycol isopentyl methyl ether, tripropyleneglycol isopentyl methyl ether, ethyleneglycol isohexyl methyl ether, diethyleneglycol isohexyl methyl ether, triethyleneglycol isohexyl methyl ether, propyleneglycol isohexyl methyl ether, dipropyleneglycol isohexyl methyl ether, tripropyleneglycol isohexyl methyl ether, and mixtures thereof.

Preferred glycol ether solvents according to Formula I are ethyleneglycol n-butyl ether, diethyleneglycol n-butyl ether, triethyleneglycol n-butyl ether, propyleneglycol n-butyl ether, dipropyleneglycol n-butyl ether, tripropyleneglycol n-butyl ether, and mixtures thereof.

The most preferred glycol ether solvents according to Formula I are propyleneglycol n-butyl ether, dipropyleneglycol n-butyl ether, and mixtures thereof.

Suitable glycol ether solvents according to Formula II include propyleneglycol n-propyl ether, dipropyleneglycol n-propyl ether, tripropyleneglycol n-propyl ether, propyleneglycol isopropyl ether, dipropyleneglycol isopropyl ether, tripropyleneglycol isopropyl ether, propyleneglycol n-propyl methyl ether, dipropyleneglycol n-propyl methyl ether, tripropyleneglycol n-propyl methyl ether, propyleneglycol isopropyl methyl ether, dipropyleneglycol isopropyl methyl ether, tripropyleneglycol isopropyl methyl ether, and mixtures thereof.

Preferred glycol ether solvents according to Formula II are propyleneglycol n-propyl ether, dipropyleneglycol n-propyl ether, and mixtures thereof.

The most preferred glycol ether solvents are propyleneglycol n-butyl ether, dipropyleneglycol n-butyl ether, and mixtures thereof, especially dipropyleneglycol n-butyl ether.

Suitable glycol ether solvents can be purchased from The Dow Chemical Company, in particularly from the E-series (ethylene glycol based) Glycol Ether and the P-series (propylene glycol based) Glycol Ether line-ups. Suitable glycol ether solvents include Butyl Carbitol, Hexyl Carbitol, Butyl Cellosolve, Hexyl Cellosolve, Butoxytriglycol, Dowanol Eph, Dowanol PnP, Dowanol DPnP, Dowanol PnB, Dowanol DPnB, Dowanol TPnB, Dowanol PPh, and mixtures thereof.

Suitable alcohols can be selected from the group consisting of C4-C6 linear mono-alcohols, branched C4-C10 mono-alcohols having one or more C1-C4 branching groups, alkyl mono-glycerols, and mixtures thereof.

Preferred C4-C6 linear mono-alcohols are selected from pentanol, hexanol, and mixtures thereof, preferably 1-pentanol, 1-hexanol, and mixtures thereof.

Preferred branched C4-C10 mono-alcohols having one or more C1-C4 branching groups for use herein are C4-C8 primary mono-alcohols having one or more C1-C4 branching groups, and mixtures thereof. Especially preferred branched C4-C10 mono-alcohols having one or more C1-C4 branching groups for use herein include methyl butanol, ethyl butanol, methyl pentanol, ethyl pentanol, methyl hexanol, ethyl hexanol, propyl hexanol, dimethyl hexanol trimethyl hexanol, methyl hepanol, ethyl heptanol, propyl heptanol, dimethyl heptanol, trimethyl heptanol, methyl octanol, ethyl octanol, propyl octanol, butyl octanol, dimethyl octanol, trimethyl octanol, methyl nonanol, ethyl nonanol, propyl nonanol, butyl nonanol, dimethyl nonanol and trimethyl nonanol, and mixtures thereof. More preferred for use herein are the primary 1-alcohol member of branched C4-C10 mono-alcohols having one or more C1-C4 branching groups, especially preferred are the primary 1-alcohol family members of methyl butanol, ethyl butanol, methyl pentanol, ethyl pentanol, methyl hexanol, ethyl hexanol, propyl hexanol, dimethyl hexanol trimethyl hexanol, methyl hepanol, ethyl heptanol, propyl heptanol, dimethyl heptanol, trimethyl heptanol, methyl octanol, ethyl octanol, propyl octanol, butyl octanol, dimethyl octanol, trimethyl octanol, methyl nonanol, ethyl nonanol, propyl nonanol, butyl nonanol, dimethyl nonanol, trimethyl nonanol, and mixtures thereof.

More preferred alcohols are butyl octanol, trimethyl hexanol, ethyl hexanol, propyl heptanol, methyl butanol, and mixtures thereof, in particular the primary 1-alcohol family member, more in particular ethyl hexanol, butyl octanol, trimethyl hexanol, and mixtures thereof, especially 2-ethyl-1-hexanol, 2-butyl-1-octanol, 3,5,5 trimethyl-1-hexanol, and mixtures thereof.

Preferred alkyl mono-glycerols are selected from the group consisting of branched alkyl mono-glycerols and mixtures thereof, more preferably branched C4-C8 alkyl mono-glycerols with one or more C1 to C4 alkyl branching groups, more preferably selected from the group consisting of ethylhexylglycerol, propylheptylglycerol, and mixtures thereof, most preferably 2-ethylhexylglycerol.

Such alcohols can also improve sudsing.

Especially preferred for use herein are mixtures of mono-alcohols, in particular mixtures comprising a branched C4-C10 mono-alcohol, more in particular mixtures comprising an alcohol selected from the group comprising C4-C8 more preferably C6-C7 branched primary alcohols. Preferably for use is a mixture of alcohols comprising an alcohol selected from the group comprising C4-C8 branched primary alcohols with an alcohol selected of the group of C4-C6 linear mono-alcohols and alkylglycerols. Such mixtures can boost foaming and improve cleaning of various oily soils.

Suitable ester solvents can be selected from the group consisting of monoester solvents of Formula III, di- or triester solvents of formula IV, benzylbenzoate, and mixtures thereof.

a) Monoester solvents of formula III: R1C═OOR2, wherein:

R1 is a linear of branched C1 to C4 alkyl, preferably a linear or branched C2 to C3 alkyl;

R2 is a linear or branched C2 to C8 alkyl, preferably a linear or branched C2 to C6 alkyl, most preferably a linear of branched C3 to C4 alkyl;

b) Di- or triester solvents of formula IV: R1(C═OOR2)n, wherein:

R1 is a saturated or unsaturated C2 to C4 alkyl;

R2 is independently selected from a linear or branched C2 to C8 alkyl, preferably a linear or branched C2 to C6 alkyl, most preferably a linear of branched C3 to C4 alkyl;

n is 2 or 3 preferably 2;

Suitable monoester solvents of formula III include but are not limited to ethylacetate, propylacetate, isopropylacetate, butylacetate, isobutylacetate, amylacetate, isoamylacetate, hexylacetate, isohexylacetate, heptylacetate, isoheptylacetate, octylacetate, isooctylacetate, 2-ethylhexylacetate, ethylpropionate, propylpropionate, isopropylpropionate, butylpropionate, isobutylpropionate, amylpropionate, isoamylpropionate, hexylpropionate, isohexylpropionate, heptylpropionate, isoheptylpropionate, octylpropionate, isooctylpropionate, 2-ethylhexylpropionate, ethylbutyrate, propylbutyrate, isopropylbutyrate, butylbutyrate, isobutylbutyrate, amylbutyrate, isoamylbutyrate, hexylbutyrate, isohexylbutyrate, heptylbutyrate, isoheptylbutyrate, octylbutyrate, isooctylbutyrate, 2-ethylhexylbutyrate, ethylisobutyrate, propylisobutyrate, isopropylisobutyrate, butylisobutyrate, isobutylisobutyrate, amylisobutyrate, isoamylisobutyrate, hexylisobutyrate, isohexylisobutyrate, heptylisobutyrate, isoheptylisobutyrate, octylisobutyrate, isooctylisobutyrate, 2-ethylhexylisobutyrate, ethylpentanoate, propylpentanoate, isopropylpentanoate, butylpentanoate, isobutylpentanoate, amylpentanoate, isoamylpentanoate, hexylpentanoate, isohexylpentanoate, heptylpentanoate, isoheptylpentanoate, octylpentanoate, isooctylpentanoate, 2-ethylhexylpentanoate, ethylisopentanoate, propylisopentanoate, isopropylisopentanoate, butylisopentanoate, isobutylisopentanoate, amylisopentanoate, isoamylisopentanoate, hexylisopentanoate, isohexylisopentanoate, heptylisopentanoate, isoheptylisopentanoate, octylisopentanoate, isooctylisopentanoate, 2-ethylhexylisopentanoate, and mixtures thereof.

Preferred monoester solvents of formula III can be selected from the group consisting of ethylpropionate, propylpropionate, isopropylpropionate, butylpropionate, isobutylpropionate, amylpropionate, isoamylpropionate, hexylpropionate, isohexylpropionate, ethylbutyrate, propylbutyrate, isopropylbutyrate, butylbutyrate, isobutylbutyrate, amylbutyrate, isoamylbutyrate, hexylbutyrate, isohexylbutyrate, ethylisobutyrate, propylisobutyrate, isopropylisobutyrate, butylisobutyrate, isobutylisobutyrate, amylisobutyrate, isoamylisobutyrate, hexylisobutyrate, isohexylisobutyrate, and mixtures thereof.

Most preferably, the monoester solvents are selected from the group consisting of propylpropionate, isopropylpropionate, butylpropionate, isobutylpropionate, propylbutyrate, isopropylbutyrate, butylbutyrate, isobutylbutyrate, propylisobutyrate, isopropylisobutyrate, butylisobutyrate, isobutylisobutyrate, and mixtures thereof.

Suitable di- or tri-ester solvents of formula IV can be selected from: ethyl-, propyl-, isopropyl-, butyl-, isobutyl-, amyl-, isoamyl-, hexyl-, isohexyl-, heptyl-, isoheptyl, octyl-, isooctyl-, 2-ethylhexy-di- or tri-esters of succinic acid, glutaric acid, adipic acid, maleic acid, fumaric acid, glutaconic acid, citric acid, aconitic acid, propane-1,2,3-tricarboxylic acid, and mixtures thereof.

Preferred di- or tri-ester solvents are selected from the group consisting of ethyl-, propyl-, isopropyl-, butyl-, isobutyl-, amyl-, isoamyl-, hexyl-, isohexyl-di- or tri-esters of succinic acid, glutaric acid, adipic acid, maleic acid, fumaric acid, glutaconic acid, citric acid, aconitic acid, propane-1,2,3-tricarboxylic acid, and mixtures thereof.

More preferably, the di- or tri-ester solvents are selected from the group consisting of ethyl-, propyl-, isopropyl-, butyl-, isobutyl-di- or tri-esters of succinic acid, glutaric acid, adipic acid, maleic acid, fumaric acid, glutaconic acid, citric acid, aconitic acid, propane-1,2,3-tricarboxylic acid, and mixtures thereof.

Further Optional Ingredients:

Chelant:

The composition herein may optionally further comprise a chelant at a level of from 0.1% to 10%, preferably from 0.2% to 5%, more preferably from 0.2% to 3%, most preferably from 0.5% to 1.5% by weight of the composition.

Suitable chelating agents can be selected from the group consisting of amino carboxylates, amino phosphonates, polyfunctionally-substituted aromatic chelating agents and mixtures thereof.

Amino carboxylates include ethylenediaminetetra-acetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein, as well as MGDA (methyl-glycine-diacetic acid), and salts and derivatives thereof and GLDA (glutamic-N,N-diacetic acid) and salts and derivatives thereof. GLDA (salts and derivatives thereof) is especially preferred according to the invention, with the tetrasodium salt thereof being especially preferred.

Builder:

The composition herein may comprise a builder, preferably a carboxylate builder. Salts of carboxylic acids useful herein include salts of C1-6 linear or at least 3 carbon containing cyclic acids. The linear or cyclic carbon-containing chain of the carboxylic acid or salt thereof may be substituted with a substituent group selected from the group consisting of hydroxyl, ester, ether, aliphatic groups having from 1 to 6, more preferably 1 to 4 carbon atoms, and mixtures thereof.

Preferred salts of carboxylic acids are those selected from the salts from the group consisting of salicylic acid, maleic acid, acetyl salicylic acid, 3 methyl salicylic acid, 4 hydroxy isophthalic acid, dihydroxyfumaric acid, 1,2, 4 benzene tricarboxylic acid, pentanoic acid, citric acid, and mixtures thereof, preferably citric acid.

Alternative carboxylate builders suitable for use in the composition of the invention includes salts of fatty acids like palm kernel derived fatty acids or coconut derived fatty acid, or salts of polycarboxylic acids.

The cation of the salt is preferably selected from alkali metal, alkaline earth metal, monoethanolamine, diethanolamine or triethanolamine and mixtures thereof, preferably sodium.

The carboxylic acid or salt thereof, when present, is preferably present at the level of from 0.05% to 5%, more preferably from 0.1% to 1% by weight of the total composition.

Hydrotropes

The composition according to the invention might further comprise a hydrotrope. Preferably the hydrotrope is selected from cumene sulphonate, xylene sulphonate, toluene sulphonate, most preferably sodium neutralized cumene sulphonate. When present the hydrotrope is formulated from 0.1% to 5%, preferably from 0.25% to 3%, most preferably from 0.5% to 2% by weight of the detergent composition.

Shear Thinning Rheology Modifier:

The composition according to the invention might further comprise a rheology modifying agent, providing a shear thinning rheology profile to the product. Formulating with a rheology modifying polymer can improve particle size distribution of the resultant spray, as well as mitigating any stinging effect of the spray droplets. Preferably the rheology modifying agent is a non crystalline polymeric rheology modifier. This polymeric rheology modifier can be a synthetic or a naturally derived polymer.

Examples of naturally derived polymeric structurants of use in the present invention include: hydroxyethyl cellulose, hydrophobically modified hydroxyethyl cellulose, carboxymethyl cellulose, polysaccharide derivatives and mixtures thereof. Polysaccharide derivatives include but are not limited to pectine, alginate, arabinogalactan (gum Arabic), carrageenan, gum karaya, gum tragacanth, gellan gum, xanthan gum and guar gum. Examples of synthetic polymeric structurants of use in the present invention include polymers and copolymers comprising polycarboxylates, polyacrylates, polyurethanes, polyvinylpyrrolidone, polyols and derivatives and mixtures thereof. Alternatively the composition of use in the invention can comprise a polyethylenoxide (PEO) polymer.

Preferably the composition according to the invention comprises a rheology modifying polymer selected from a naturally derived rheology modifying polymer, most preferably Xanthan Gum, a polyethylenoxide, or mixtures thereof.

Generally, the rheology modifying polymer will be comprised at a level of from 0.001% to 1% by weight, alternatively from 0.01% to 0.5% by weight, more alternatively from 0.05% to 0.25% by weight of the composition.

Other Ingredients:

The composition herein may comprise a number of optional ingredients such as rheology trimming agents selected from inorganic salts preferably sodium chloride, C2-C4 alcohols, C2-C4 polyols, poly alkylene glycols and especially polypropyleneglycols having a weight average molecular weight of from 1500 to 4,000, and mixtures thereof.

The compositions of the present invention can comprise a cleaning amine such as a cyclic cleaning amine. The term "cyclic diamine" herein encompasses a single cleaning amine and a mixture thereof. The amine can be subjected to protonation depending on the pH of the cleaning medium in which it is used. Especially preferred for use herein are cyclic diamines selected from the group consisting of 1, 3-bis(methylamine)-cyclohexane, 2-methylcyclohexane-1, 3-diamine, 4-methylcyclohexane-1,3-diamine and mixtures thereof. 1, 3-bis(methylamine)-cyclohexane is especially preferred for use herein. Mixtures of 2-methylcyclohexane-1,3-diamine, 4-methylcyclohexane-1,3-diamine are also preferred for use herein.

The composition might also comprise pH trimming and/or buffering agents such as sodium hydroxyde, alkanolamines including monoethanolamine, and bicarbonate inorganic salts. The composition might comprise further minor ingredients selected from preservatives, UV stabilizers, antioxidants, perfumes, coloring agents and mixtures thereof.

Since it is undesireable to spray compositions comprising enzymes, the composition is preferably free of enzymes and particularly free of amylase due to possible hypersensitivity to such enzymes.

Spray Dispenser:

The spray dispenser comprises a reservoir to accommodate the composition of the invention and spraying means. Suitable spray dispensers include hand pump (sometimes referred to as "trigger") devices, pressurized can devices, electrostatic spray devices, etc. Preferably the spray dispenser is non-pressurized and the spray means are of the trigger dispensing type. The reservoir is typically a container such as a bottle, more typically a plastic bottle.

The cleaning product of the invention includes the cleaning composition. The cleaning composition is typically suitable for spraying from the spray dispenser onto the dish surface to be treated ("direct application"). The composition preferably forms a foam on the surface immediately upon application without requiring any additional physical (e.g., manual rubbing) intervention.

The spray dispenser typically comprises a trigger lever which, once depressed, activates a small pump. The main moving element of the pump is typically a piston, housed inside a cylinder, with the piston pressing against a spring. By depressing the trigger, the piston is pushed into the cylinder and against the spring, compressing the spring, and forcing the composition contained within the pump out of a nozzle. Once the trigger lever is released, the spring pushes the piston back out, expanding the cylinder area, and sucking the composition from the reservoir, typically through a one-way valve, and refilling the pump. This pump is typically attached to a tube that draws the composition from the reservoir into the pump. The spray dispenser can comprise a further one-way valve, situated between the pump and the nozzle.

The nozzle comprises an orifice through which the composition is dispensed. The nozzle utilises the kinetic energy of the composition to break it up into droplets as it passes through the orifice. Suitable nozzles can be plain, or shaped, or comprise a swirl chamber immediately before the orifice. Such swirl chambers induce a rotary fluid motion to the composition which causes swirling of the composition in the swirl chamber. A film is discharged from the perimeter of the orifice which typically results in dispensing the composition from the orifice as finer droplets.

Since such trigger-activated spray dispensers comprise a pump, the composition preferably is not pressurized within the reservoir and preferably does not comprise a propellant.

The spray dispenser can be a pre-compression sprayer which comprises a pressurized buffer for the composition, and a pressure-activated one-way valve between the buffer and the spray nozzle. Such precompression sprayers provide a more uniform spray distribution and more uniform spray droplet size since the composition is sprayed at a more uniform pressure. Such pre-compression sprayers include the Flairosol® spray dispenser, manufactured and sold by Afa Dispensing Group (The Netherlands) and the pre-compression trigger sprayers described in U.S. Patent Publication Nos. 2013/0112766 and 2012/0048959.

Method of Use:

The cleaning products, as described herein, are particularly suited for methods of cleaning dishware comprising the steps of: optionally pre-wetting the dishware; spraying the cleaning composition onto the dishware; optionally scrubbing the dishware; and rinsing the dishware.

The cleaning products described herein are particularly effective at loosening soils, and especially greasy soils. As such, especially for light soiling, scrubbing is optional, and particularly when the dishware is left for at least 15 seconds, preferably at least 30 seconds after the spray step, before the rinsing step is done.

The steps of scrubbing of the dishware and rinsing the dishware can take place at least partially simultaneously, for example, by scrubbing the dishware under running water or when the dishware is submerged in water. The scrubbing step can take between 1 second and 30 seconds.

The present method allows for faster and easier cleaning of dishware when the dishware is lightly soiled. When the dishware is heavily soiled with tough food soils such as cooked-, baked or burnt-on soils, the present method facilitates the cleaning when the soiled dishware is soaked with the product of the invention in neat form or diluted in water, preferably for a period of from 1 second to 30 seconds, or longer.

Methods

A) Reserve Alkalinity:

Reserve alkalinity is defined as the grams of NaOH per 100 g of composition required to titrate the test composition at pH 10 to come to the test composition pH. The reserve alkalinity for a solution is determined in the following manner.

A pH meter (for example An Orion Model 720A) with a Ag/AgCl electrode (for example an Orion sure flow Electrode model 9172BN) is calibrated using standardized pH 7 and pH 10 buffers. A 100 g of a 10% solution in distilled water at 20° C. of the composition to be tested is prepared. The pH of the 10% solution is measured and the 100 g solution is titrated down to pH 10 using a standardized solution of 0.1 N of HCl. The volume of 0.1N HCl required is recorded in ml. The reserve alkalinity is calculated as follows:

Reserve Alkalinity=ml 0.1N HCl×0.1 (equivalent/liter)×Equivalent weight NaOH (g/equivalent)×10

B) Viscosity:

The rheology profile is measured using a "TA instruments DHR1" rheometer, using a cone and plate geometry with a flat steel Peltier plate and a 60 mm diameter, 2.026° cone (TA instruments, serial number: SN960912). The viscosity measurement procedure includes a conditioning step and a sweep step at 20° C. The conditioning step consists of a 10 seconds at zero shear at 20° C., followed by pre-shearing for 10 seconds at 10 $s^{-1}$ at 20° C., followed by 30 seconds at zero shear at 20° C. in order for the sample to equilibrate. The sweep step comprises a logarithmical shear rate increase in log steps starting from 0.01 $s^{-1}$ to 3,000 $s^{-1}$ at 20° C., with a 10 points per decade acquisition rate taken in a sample period of 15 s, after a maximum equilibration time of 200 seconds (determined by the rheometer, based on a set tolerance of 3%). When measuring shear thinning product compositions, the high shear viscosity is defined at a shear rate of 1,000 $s^{-1}$, and the low shear viscosity at a shear rate of 0.1 $s^{-1}$. For Newtonian product compositions the shear rate is recorded at 1,000 $s^{-1}$.

C) Initial Foam Volume and Foam Mileage:

To be able to cross-compare the initial foam volume creation and foam mileage potential of a range of test formulations, these test formulations are sequentially placed within the same trigger sprayer, which is held under a fixed 45° angle with the spray nozzle being positioned at the centre top of an open 500 ml graduated conical beaker (Kartell® Art 1424, conical beaker). The sprayer bottle is consequently sprayed 10 times and the amount of foam volume created (ml) as well as the total weight of sprayed product is measured. The foam volume divided by the weight of the sprayed sample value is calculated and averaged for 3 test replicates for each product—spray bottle combination. The foam volume is remeasured every 5 minutes for a total of at least 25 minutes.

D) % Polymerized Grease Removal:

In order to cross-compare the polymerized grease removal efficacy of different test formulae, the following procedure was used:

Preparation of the Tiles:

A consumer representative greasy soil was prepared by blending homogeneously 33.17 g of each of the following oils: peanut, corn and sunflower oil dyed, and 0.5 g of Lumogen dye was added in order to make the soil more visible.

0.65±0.05 gram of the soil was applied to an enamel tile using a roller of 11 cm in diameter. The soiled tiles were then cooked for 3 hours and 10 minutes in an oven (at 140° C.) and then left to cool to room temperature. The tiles were then stored at a constant humidity (70%) and temperature of 25 C for at least 24 hours.

Test Execution:

The test formulae were sprayed (preferably using a Flairosol® sprayer, supplied by AFA) onto the soiled tiles comprising the polymerized greasy soil, so that approximately 1.4 g of the composition was applied to the soiled tile. 10 g of water having a hardness of 1.2 mmol/1 CaCO3 at room temperature was distributed homogeneously over a dish sponge (4.3×8.8 cm) and the sponge applied to the soiled tile in repeated backward and forward strokes with a constant applied pressure (200 g weight applied to the sponge), and the number of strokes required to remove 50%. 70% and 90% of the polymerized grease was recorded.

EXAMPLES

The polymerized grease removal efficacy and suds mileage was assessed for liquid detergent spray formulae comprising a surfactant system according to the invention (Example 1) and a comparative composition outside the scope of the invention (Example A).

Inventive example 1 comprises C12 to 14 alkyl ethoxylated (3.0) sulphate as the main surfactant and n-C12-C14 alkyl-n-methylglucamide as the co-surfactant.

Comparative Example A differed from Inventive Example 1 by comprising an amine oxide surfactant instead of n-C12-C14 alkyl-n-methylglucamide as the co-surfactant.

TABLE 1

| Liquid spray detergent compositions | | |
|---|---|---|
| | Ex 1 | Ex A* |
| C1214AE3S anionic surfactant | 6.54 | 6.54 |
| n-C12-C14-n-methylglucamide (Glucopure ® Foam ex Clariant) | 2.46 | — |
| C1214 dimethylamine oxide | — | 2.46 |
| C6EO5 nonionic surfactant[1] | 5.00 | 5.00 |
| Monoethanolamine | 0.50 | 0.50 |
| GLDA chelant | 1.00 | 1.00 |
| Citric acid | 0.12 | 0.12 |
| PPG (MW 2000) | 0.05 | 0.05 |
| ethanol | 0.34 | 0.34 |
| DPnB glycol ether solvent | 5.00 | 5.00 |
| phenoxyethanol | 0.30 | 0.30 |
| perfume | 0.35 | 0.35 |
| water | 78.34 | 78.34 |
| pH (neat) | 11.0 | 11.0 |

*Comparative

[1]Lutensol CS6250, supplied by BASF

All of the compositions were tested using the same spray dispenser, available from the AFA company, under the Flairosol® tradename.

As can be seen from the data below, Example 1 comprising anionic surfactant as the main surfactant and using n-C12-C14-n-methylglucamide as the co-surfactant, resulted in improved suds mileage, as well as polymerized grease removal, in comparison to that from comparative composition A, comprising amine oxide surfactant instead of n-C12-C14-n-methylglucamide as the co-surfactant.

TABLE 2

| Suds mileage and polymerized grease removal: | | |
|---|---|---|
| | Ex 1 | Ex A* |
| Initial suds volume (ml/g) | 7.1 | 11.6 |
| % of initial suds remaining after: | | |
| 5 min | 83.1 | 84.5 |
| 10 min | 62.0 | 66.4 |
| 15 min | 45.1 | 25.9 |
| 20 min | 31.0 | 12.9 |
| 25 min | 23.9 | 6.9 |
| 30 min | 21.1 | 4.3 |
| Number of strokes to remove: | | |
| 50% of the polymerized grease | 14 | 15 |
| 70% of the polymerized grease | 21 | 24 |
| 90% of the polymerized grease | 28 | 40 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning product comprising a spray dispenser and a cleaning composition, wherein:

the cleaning composition is housed in the spray dispenser;

the cleaning composition comprises from about 5% to about 25% by weight of the cleaning composition of a surfactant system; and the surfactant system comprises:

a. an anionic surfactant;

b. an alkyl glucamide surfactant, wherein the alkyl glucamide surfactant has the formula:

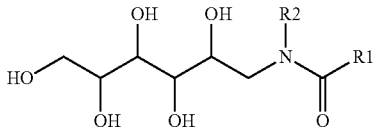

(I)

wherein in formula (I):

R1 is a linear or branched, saturated or unsaturated alkyl chain comprising from 8 to 18 carbon atoms; and R2 is an alkyl group having from 1 to 4 carbon atoms;

wherein the anionic surfactant and alkyl glucamide surfactant are present at a weight ratio of greater than about 1:1; and the cleaning composition has a Newtonian viscosity of from 1 to 50 mPa·s.

2. The cleaning product according to claim 1, wherein the cleaning composition comprises from about 7% to about 20% by weight thereof of the surfactant system.

3. The cleaning product according to claim 1, wherein the cleaning composition comprises the anionic surfactant at a level of from about 2.0 to about 12% by weight of the composition.

4. The cleaning product according to claim 1, wherein in the surfactant system of the cleaning composition, the anionic surfactant comprises: alkyl sulphated anionic surfactant selected from the group consisting of: alkyl sulphate, alkyl alkoxy sulphate, and mixtures thereof.

5. The cleaning product according to claim 4, wherein the alkyl sulphated anionic surfactant has an average degree of alkoxylation, of no more than about 5.0.

6. The cleaning product according to claim 5, wherein the alkyl sulphated anionic surfactant has an average degree of alkoxylation, of from about 1.0 to about 5.0.

7. The cleaning product according to claim 1, wherein the cleaning composition comprises the alkyl glucamide at a level of from about 0.5% to about 5.0% by weight of the cleaning composition.

8. The cleaning product according to claim 7, wherein the cleaning composition comprises the alkyl glucamide at a level of from about 1.0% to about 4.0% by weight of the cleaning composition.

9. The cleaning product according to claim 1, wherein in the alkyl glucamide surfactant, R1 is a C8-C14 alkyl chain.

10. The cleaning product according to claim 9, wherein in the alkyl glucamide surfactant, R1 is a C12-C14 alkyl chain.

11. The cleaning product according to claim 1, wherein the anionic surfactant and alkyl glucamide surfactant are present at a weight ratio of from greater than about 1:1 to about 10:1.

12. The cleaning product according to claim 1, wherein the surfactant system comprises a further nonionic surfactant at a level of from about 1.0% to about 10% by weight of the composition.

13. The cleaning product according to claim 12, wherein the further nonionic surfactant is an alkyl ethoxylate surfactant.

14. The cleaning product according to claim 13, wherein the alkyl ethoxylate surfactant has an average alkyl chain length of C10 or below, and a number average degree of ethoxylation of from about 1 to about 10.

15. The cleaning product according to claim 1, wherein the surfactant system comprises less than about 0.5% by weight of the cleaning composition of an amphoteric surfactant, zwitterionic surfactant, and mixtures thereof.

16. The cleaning product according to claim 15, wherein the surfactant system is free of amphoteric and zwitterionic surfactant.

17. The cleaning product according to claim 1, wherein the composition comprises organic solvent at a level of from about 0.1% to about 10% by weight of the composition.

18. The composition according to claim 17, wherein the organic solvent is selected from the group consisting of: glycol ether solvents, alcohol solvents, ester solvents, and mixtures thereof.

19. The cleaning product according to claim 1, wherein the composition is free of enzymes.

20. A method of cleaning dishware using the cleaning product according to claim 1, comprising the steps of:

a) optionally pre-wetting the dishware;

b) spraying the cleaning composition onto the dishware;

c) optionally scrubbing the dishware; and d) rinsing the dishware.

* * * * *